United States Patent [19]

Nix et al.

[11] Patent Number: 4,884,784

[45] Date of Patent: Dec. 5, 1989

[54] PORTABLE WINCH

[76] Inventors: Herman J. Nix, Rt. 1, Box 285, Ider, Ala. 35981; Roger D. Nix, Rt. 1, Box 263, Sylvania, Ala. 35988

[21] Appl. No.: 185,800

[22] Filed: Apr. 25, 1988

[51] Int. Cl.[4] ..... B66D 1/12; B66D 1/16

[52] U.S. Cl. ..... 254/362; 254/345

[58] Field of Search ..... 254/330, 345, 362, 342

[56] References Cited

U.S. PATENT DOCUMENTS

| | | | |
|---|---|---|---|
| 911,625 | 2/1909 | Sperry | 254/330 |
| 989,430 | 4/1911 | Sasgen | 254/345 |
| 2,559,450 | 7/1951 | Mayer | 254/345 |
| 2,947,517 | 8/1960 | Simonsen | 254/345 |
| 3,117,767 | 1/1964 | McLean | 254/362 |
| 4,158,797 | 6/1979 | Alcott | 254/362 |
| 4,566,674 | 1/1986 | Ebey | 254/345 |

FOREIGN PATENT DOCUMENTS

| | | | |
|---|---|---|---|
| 638102 | 3/1962 | Canada | 254/362 |

*Primary Examiner*—Stuart S. Levy
*Assistant Examiner*—Katherine Matecki
*Attorney, Agent, or Firm*—Leon Gilden

[57] ABSTRACT

An elongate portable winch is set forth powered by a series of rechargeable batteries. The winch is enclosed within an axially symmetrical elongate housing terminating in a securement hook at one end and a reel-in line at the other end securable to a windup drum actuated by an external switch secured to a handle integrally secured to said housing wherein a series of gear reduction drives multiplies the torque output of the apparatus to apply sufficient force to the drum. The securement hook, batteries, electric motor, gears, and windup drum are aligned within the elongate housing to enable ease of portability by use of an associated handle.

3 Claims, 4 Drawing Sheets

PORTABLE WINCH

BACKGROUND OF THE INVENTION

1. Field of the Invention

The field of invention pertains to winches, and more particularly pertains to a new and improved portable winch formed with an elongate housing with an aligned series of components for ease of portability and use of the winch.

2. Description of the Prior Art

The use of winches for the pulling and towing of various articles is well known in the prior art. The history of powered winches has been developed to ease the physical requirement of users and provide sufficient mechanical advantage to a tow-in line to enable manipulation of various objects to be pulled. For example, U.S. Pat. No. 3,042,375 to Fahey sets forth a portable winch including an offset electric motor to drive an associated drum for pulling in a line which is oriented generally orthogonally to the drive motor and is secured generally to a rather massive structure wherein the portability of the winch of Fahey appears to rely on the use of light-weight magnesium and the like to limit weight, but the Fahey patent sets forth a winch of rather expansive and elaborate structure as opposed to the instant invention which sets forth an aligned series of components for portability and provides for a rechargeable battery pack to provide motivation to a tow-in line.

U.S. Pat. No. 3,802,666 to Haberthier sets forth a framework for attachment of a winch wherein the essence of the invention includes an integral mounting stand, motor and spindle removably mounted to a mounting plate by a series of bolted pins to provide for selective securement of the winch to a support as desired where essentially the function and structure of the patent is of a relatively remote organization to that of the instant invention to set forth a uniquely portable hand-held winch for selective use by an individual.

U.S. Pat. No. 3,929,555 to Sanders is cited for the use of a battery-powered winch wherein an elaborate framework secures a winch in an underlying position to a conventional automotive wet cell to enable stripping of layer material from a conveyor secured between a clamping arrangement in an aligned remote orientation relative to the winch. The Sanders patent is of interest relative to a portable winch in that the entire framework is secured on wheels, but the essence of the winch is quite removed structurally and functionally from the instant invention.

U.S. Pat. No. 4,331,323 to Sekimori, et al., provides an electric winch system for use in apparent combination in an automotive environment wherein the patent essentially sets forth the cooperation of the various winch components to that of the automotive environment for use. The patent is essentially a refinement of conventional winches commercially available.

U.S. Pat. No. 4,555,093 to Plummer sets forth a winch or cable pulling device wherein a control unit includes a force indicator gage with a switch and circuit breaker such that upon an overload level being approached, the winch power is interrupted.

As such, it may be appreciated that there is continuing need for a new and improved portable winch which combines the features of portability, alignment of components for effecting such portability, and ease of use, and in this respect the present invention substantially fulfills this need.

SUMMARY OF THE INVENTION

In view of the foregoing disadvantages inherent in the known types of winches now present in the prior art, the present invention provides an portable winch wherein the same may be compactly transported and may be further easily and efficiently oriented for utilization as desired. As such, the general purpose of the present invention, which will be described subsequently in greater detail, is to provide a new and improved portable winch which has all the advantages of the prior art winches and none of the disadvantages.

To obtain this, the present invention comprises a portable winch formed within a unitary elongate enclosed housing provided with a series of rechargeable batteries and a rechargeable outlet at one end of the housing with a motor and gear train aligned within said housing and with said components and terminating in a windup drum selectively disengageable by an externally positioned release rod integrally secured to gears driving said windup drum.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable winch which has all the advantages of the prior art portable winches and none of the disadvantages.

It is another object of the present invention to provide a new and improved portable winch which may be easily and efficiently manufactured and marketed.

It is a further object of the present invention to provide a new and improved portable winch which is of a durable and reliable construction.

An even further object of the present invention is to provide a new and improved portable winch which is susceptible of a low cost of manufacture with regard to both materials and labor, and which accordingly is then susceptible of low prices of sale to the consuming public, thereby making such portable winches economically available to the buying public.

Still yet another object of the present invention is to provide a new and improved portable winch which provides in the apparatuses and methods of the prior art some of the advantages thereof, while simultaneously overcoming some of the disadvantages normally associated therewith.

Still another object of the present invention is to provide a new and improved portable winch wherein a rechargeable battery pack is provided with a rechargeable outlet to an AC source aligned with an electric motor further aligned with a winch windup drum for providing a series of components positionable within an elongate self-contained housing formed with a handle and external switch for portability and usage thereof.

Yet another object of the present invention is to provide a new and improved portable winch wherein an externally mounted disengagement plunger has axially formed thereon with said housing drive gears associated with a windup drum for manual disengagement of the windup drum with the associated motor force provided by the electric motor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
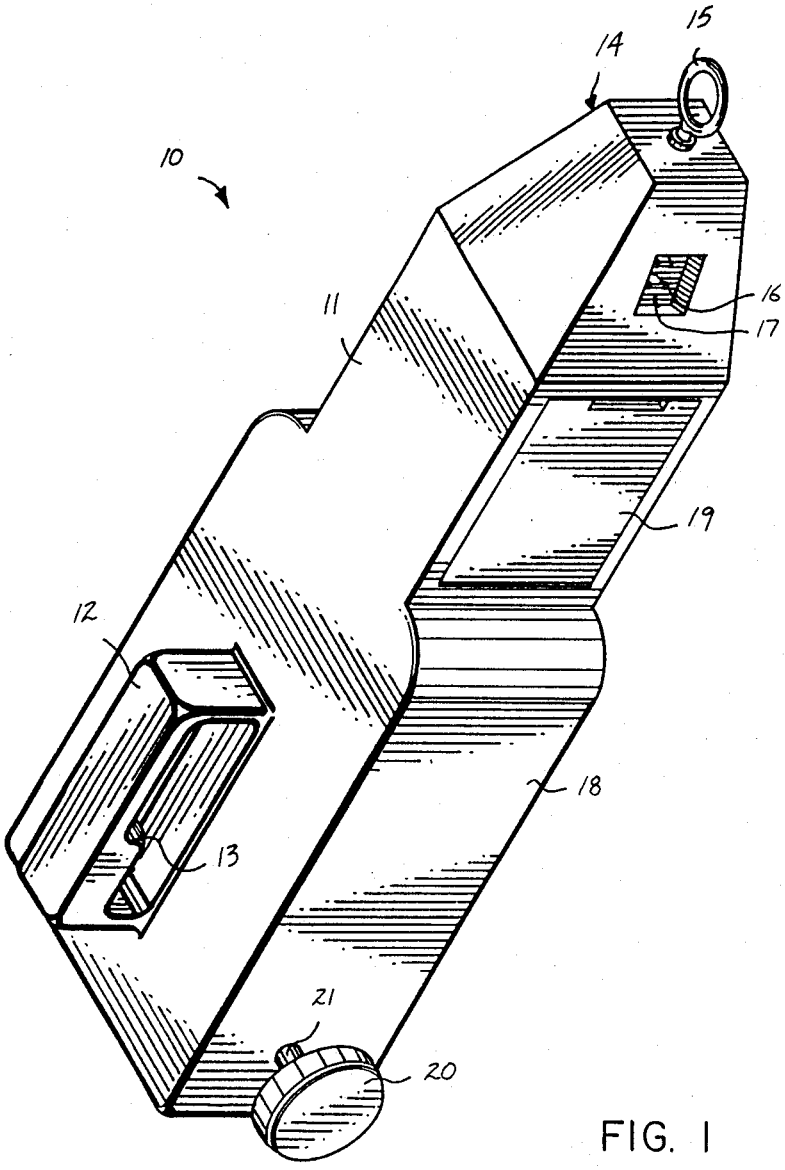
FIG. 1 is an isometric illustration of the instant invention.
Figure 2:
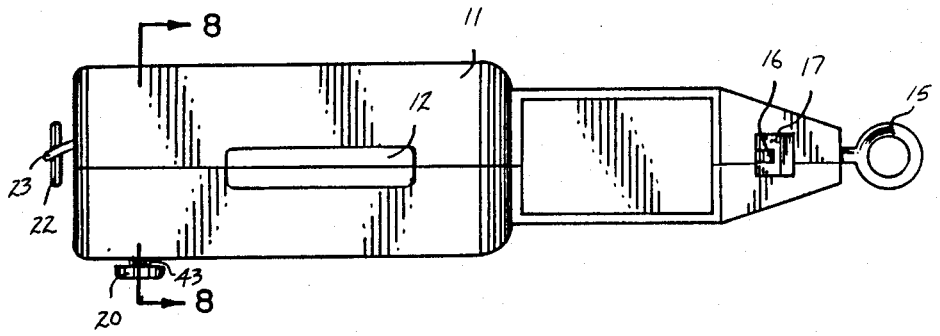
FIG. 2 is a top orthographic view of the instant invention.
Figure 3:
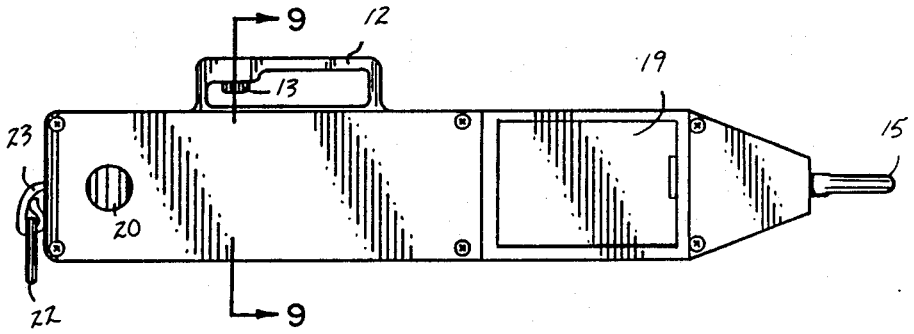
FIG. 3 is an orthographic view taken in elevation of the instant invention.

With reference now to the drawings, and in particular to FIGS. 1 to 9 thereof, a new and improved portable winch embodying the principles and concepts of the present invention and generally designated by the reference numeral 10 will be described.

More specifically, it will be noted that the portable winch apparatus 10 essentially comprises an elongate generally bottle-shaped housing formed of polymeric-like high strength material formed with a top surface 11 having integrally secured thereto a handle 12. An on/-off switch 13 is positioned within said handle 12 for convenient access by a user of the device. Furthermore, the handle 12 is oriented upon top surface 11 overlying the center of gravity of the instant invention to enhance the portability of the device by a user.

Figure 4:
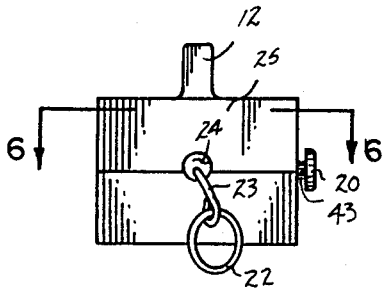
FIG. 4 is an end orthographic view of the instant invention.
Figure 5:
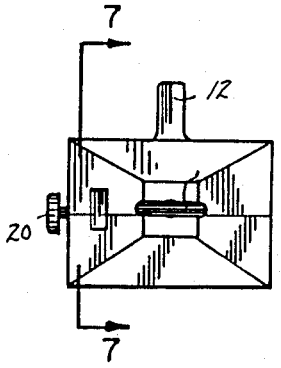
FIG. 5 is a frontal orthographic view taken in elevation of the instant invention.

Oriented at a forward distal end portion of the apparatus is a truncated pyramidal nose section 14 having secured thereto on an end surface, a securement loop 15. The securement loop 15 is integrally secured to the nose section 14 for anchoring the device to a fixed point whereupon the connecting loop 22 emanating from the other distal end 25 of the device, as illustrated in FIG. 4 for example, may thereby pull an article relative to the apparatus when the securement loop 15 is firmly anchored.

Figure 6:
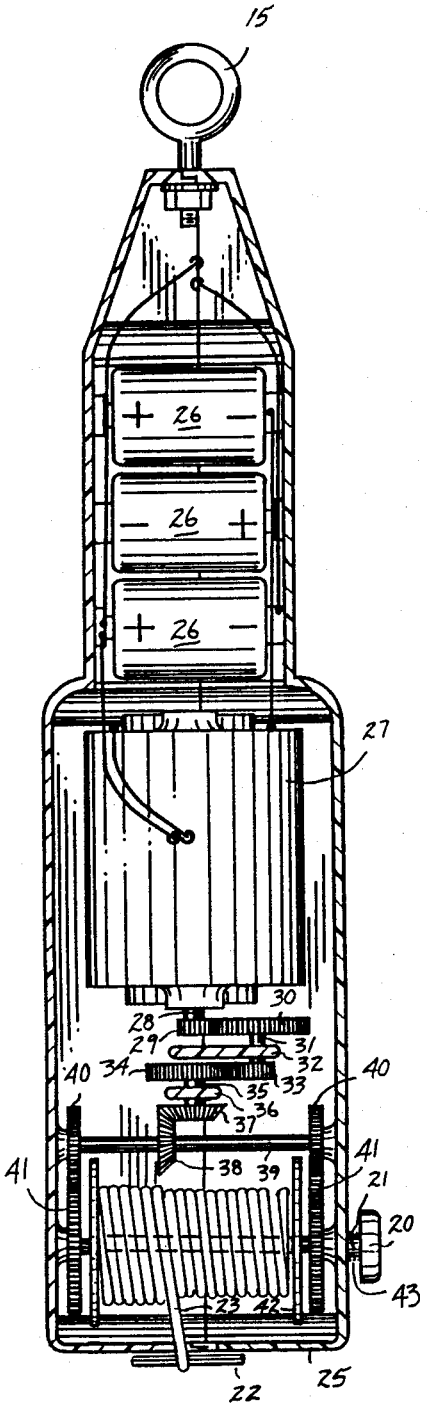
FIG. 6 is an orthographic taken along the lines 6—6 of FIG. 4 in the direction indicated by the arrows.

The apparatus further includes an alternating current to direct current plug 16 formed on the nose section 14 within a protective recessed cavity 17 to protect the plug 16 from inadvertent damage during use of the device. A side surface 18 includes an access cover for communication with a series of rechargeable batteries 26 for their replacement and/or service, as may be deemed necessary. Further reference to FIG. 1 illustrates a disengagement plunger 20 secured to a plunger shaft 21 to manually disengage gear train engagement of the drum 42 to either provide immediate disengagement during a winching procedure or to enable an operator of the instant invention, by depressing plunger 20, to allow retrievable line 23 to be withdrawn from within the housing by effecting a "free-wheeling" of the drum 42, as illustrated in FIG. 6. The retriever line 23 may be unwound from about the drum 42 through the opening 24 within the rear end surface 25 of the apparatus.

Figure 7:
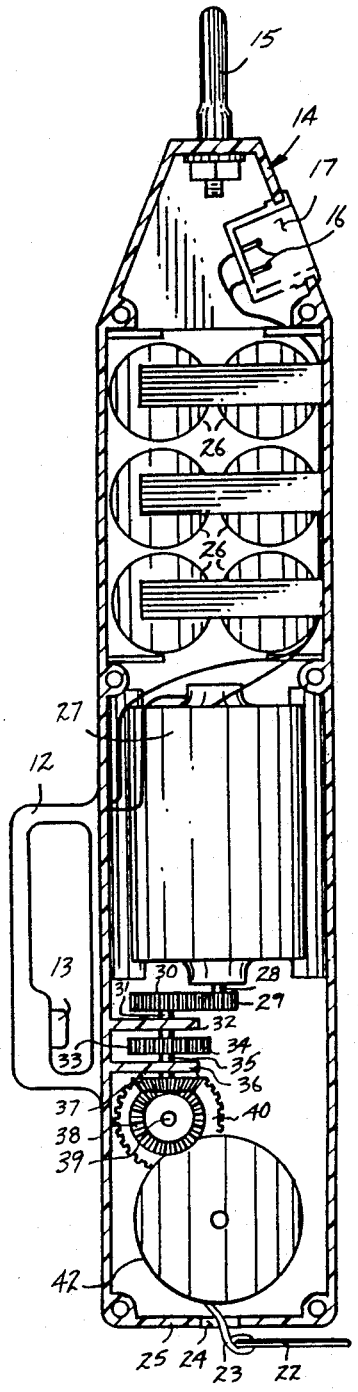
FIG. 7 is an orthographic view taken along the lines 7—7 of FIG. 5 in the direction indicated by the arrows.

Attention to FIGS. 6 and 7 illustrates a series of six rechargeable batteries 26 in electrical communication with one another in electrical series and operative by means of the aforenoted on/off switch 13. The rechargeable batteries 26 upon engagement of switch 13 energize a DC motor 27 positioned medially of the length of the surrounding housing. The housing of the instant invention totally encompassing the various components therein.

The motor 27 is provided with a first output shaft 28 integrally secured to a first output gear 29. First output gear 29 is in engagement with a second gear 30 of approximately twice the diameter of the first output gear and cooperates with a third gear 33 through a second output shaft 31 supported by a first support 32 which is formed as a tab orthogonally secured to an interior surface of the housing. The third gear 33 is of a diameter comparable or even somewhat less than that of first output gear 29 and is in engaging communication with a fourth gear 34 of approximately a four or five to one ratio with respect to the third gear 33. The fourth gear thereby provides a speed reduction and torque multiplication of approximately a four to one ratio with respect to the initial output of the motor 27 and wherein the fourth gear is in communication with a first beveled gear through a third output shaft 36 supported by second support 35 similar in nature to that of the first support 32. The first bevel gear 37 is of a diameter equal to that of orthogonally oriented second bevel gear 38 integrally formed to first drive shaft 39. The first drive shaft 39 has formed proximate its terminal ends a plurality of output gears 40 that cooperate with drum gears 41 to provide an even further speed reduction and torque multiplication as drum gears 41 are of a pre-selected ratio from approximately two to five times the diameter of the output gears 40 to tailor the retrievable torque applied to drum 42 to predetermined situations dependent on torque needs. The range of torque multiplication thereby is in a range of eight to twenty times that of motor 27.

Figure 8:
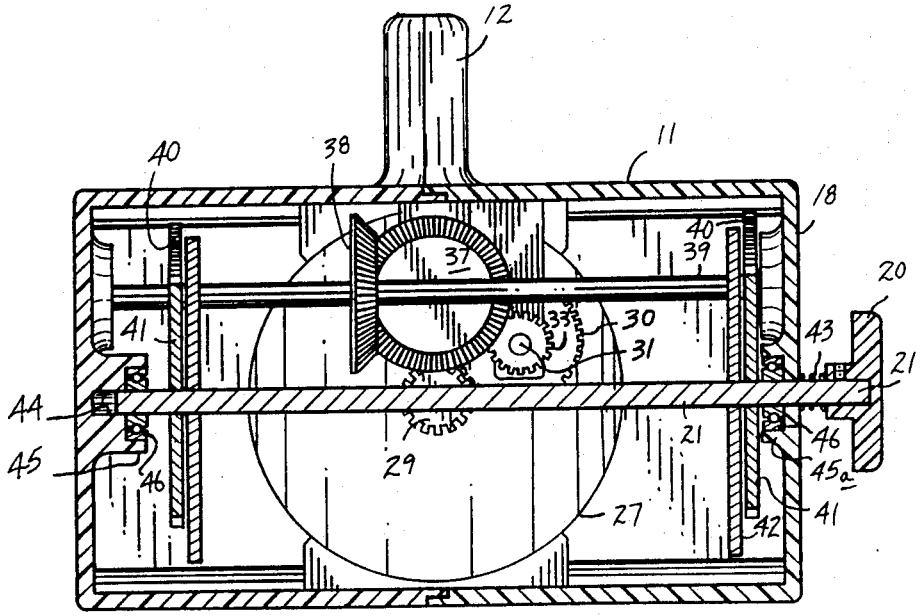
FIG. 8 is an orthographic view taken along the lines 8—8 of FIG. 2 in the direction indicated by the arrows.
Figure 9:
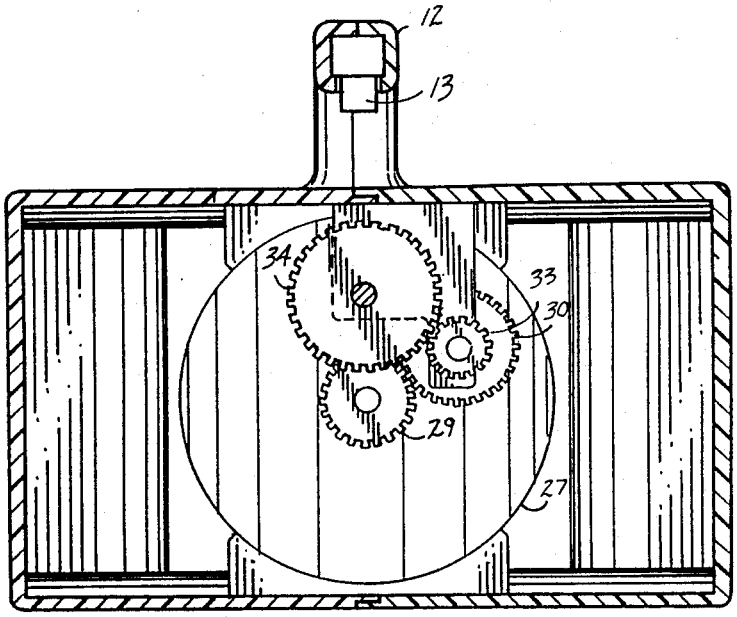
FIG. 9 is an orthographic view taken along the lines 9—9 of FIG. 3 in the direction indicated by the arrows.

With reference to FIG. 8, it will be noted that the windup drum 42 is secured to the same plunger shaft 21 that has integrally formed thereto the drum gears 41 whereupon the pressing of plunger 20 enables the plunger shaft 21 to disengage contact from the associated output gears 40 as the shaft 21 may be retracted into space 44 formed within first boss 45. A second boss 45*a*, as well as first boss 45, has formed medially therethrough and coaxially of shaft 21, a plurality of bearings 46 secured to the respective bosses 45 and 45*a* through which the shaft 21 may be slidingly pass. The plunger 20 is maintained in an extended position, as illustrated in FIG. 8, by means of a coil spring 43 located between the housing and the plunger 20. The boss 45*a* cooperates with a side surface of a drum gear 41 to maintain the extended orientation of the plunger 20 with respect to the housing and thereby enable the drum gears 41 to maintain a normal engagement relationship with the output gears 40.

The operation of the instant invention should be apparent from the above description. A user merely secures the forwardly positioned securement loop 15 to a fixed support, such as a post or the like, whereupon depression of the plunger 20 disengages the drum 42 from cooperations with the associated gear drive train and enables a withdrawal of the retriever line 23 through line opening 24 to whatever length is desired whereupon disengagement plunger 20 is released, the connecting loop 22 secured to a desired object to be moved, and switch 13 depressed to actuate motor 27 and the associated gear drive train to rotate drum 42 and thereby pull a desired object.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable winch apparatus comprising, an elongate housing means, and a direct current electrical motor, and a rechargeable battery means electrically associated with said direct current electrical motor, and a transmission means operatively coupled between said motor and said windup drum, said windup drum including a flexible line means wrapped around said windup drum terminating in a loop wherein said loop is positioned exteriorly of said housing means, and said battery means, said electrical motor, said transmission means, and said windup drum are positioned and secured within said housing and aligned within said housing with respect to one another to balance said housing means for portability, and wherein said apparatus further includes a disengagement means for manually disengaging operative association of said windup drum with said transmission means, and wherein said disengagement means includes a shaft fixedly secured to said drum and extending exteriorly of said housing, and drum gears positioned to said shaft coaxially and exteriorly of said drum and further including biasing means for maintaining said drum and said drum gears in operative coupled relationship to said transmission means including a plunger head integrally secured to said shaft and slidably mounted through said housing means to enable displacement of said shaft and displace said drum and said drum gears to a second position in an uncoupled relationship to said transmission, and wherein said shaft is rotatably secured between opposed walls of said housing within a first boss and a second boss wherein said first boss includes a retraction space for accepting a terminal end of said shaft when displaced to said second position, and wherein said first boss and said second boss further include bearings for rotatably securing said shaft coaxially of said bearings in a slip-fit relationship to said bearings, and wherein said transmission means includes a first output gear and an enlarged second gear, said first output gear rotatably and fixedly secured to an output shaft of said motor with said first output gear operatively associated with said enlarged second gear, said second gear axially displaced from said first output gear, and a third gear coaxially aligned with and spaced from said second gear and of a lesser diameter than said second gear, and a fourth gear operatively coupled to said third gear, axially displaced from said third gear and having an axis parallel to an axis of said first output gear, and a plurality of output gears coupled to said fourth gear, said output gears being selectively coupled to said drum gears, and wherein an alternating to direct current plug is positioned within said housing within a recess of said housing directed outwardly for access to a recharging plug to recharge said battery means, and wherein said battery means includes a plurality of batteries symmetrically positioned within said housing about a housing axial line coaxial with said motor.

2. A portable winch apparatus as set forth in claim 1 wherein said apparatus further includes a handle means integrally secured to said housing means overlying said motor for ease of portability of said apparatus and further including an on/off switch positioned within said motor for ease of operation of said apparatus.

3. A portable winch apparatus as set forth in claim 2 wherein said apparatus further includes a securement hook positioned at a forward terminal end of said housing at an opposite end of said housing with respect to said drum.

* * * * *